US006722452B1

(12) United States Patent
Rial et al.

(10) Patent No.: US 6,722,452 B1
(45) Date of Patent: Apr. 20, 2004

(54) PANTOGRAPH UNDERREAMER

(75) Inventors: Monty H. Rial, Dallas, TX (US); Lawrence W. Diamond, Rockwall, TX (US); Joseph A. Zupanick, Pineville, WV (US); Harold E. Payne, Spring, TX (US)

(73) Assignee: CDX Gas, LLC, Dallas, TX (US)

( * ) Notice: Subject to any disclaimer, the term of this patent is extended or adjusted under 35 U.S.C. 154(b) by 0 days.

(21) Appl. No.: 10/079,444

(22) Filed: Feb. 19, 2002

(51) Int. Cl.[7] ..... E21B 7/28; E21B 10/32
(52) U.S. Cl. ..... 175/57; 175/265; 175/284
(58) Field of Search ..... 175/57, 263, 265, 175/266, 267, 284, 292

(56) References Cited

U.S. PATENT DOCUMENTS

| | | | | |
|---|---|---|---|---|
| 54,144 | A | 4/1866 | Hamar | 175/263 |
| 274,740 | A | 3/1883 | Douglass | |
| 639,036 | A | 12/1899 | Heald | 175/263 |
| 1,189,560 | A | 7/1916 | Gondos | 175/265 |
| 1,285,347 | A | 11/1918 | Otto | 175/263 |
| 1,317,192 | A | 9/1919 | Jones | |
| 1,467,480 | A | 9/1923 | Hogue | 175/263 |
| 1,485,615 | A | 3/1924 | Jones | 175/263 |
| 1,498,463 | A | 6/1924 | Mccloskey | |
| 1,589,508 | A | 6/1926 | Boynton | |
| 1,674,392 | A | 6/1928 | Flansburg | |
| 1,710,998 | A | 4/1929 | Rudkin | |
| 1,970,063 | A | 8/1934 | Steinman | 255/74 |
| 2,018,285 | A | 10/1935 | Schweitzer et al. | 166/21 |
| 2,031,353 | A | 2/1936 | Woodruff | 255/76 |
| 2,069,482 | A | 2/1937 | Seay | 255/76 |
| 2,150,228 | A | 3/1939 | Lamb | 166/10 |
| 2,169,502 | A | 8/1939 | Santiago | 255/76 |
| 2,169,718 | A | 8/1939 | Böll et al. | 255/24 |
| 2,290,502 | A | 7/1942 | Squires | 255/76 |
| 2,450,223 | A | 9/1948 | Barbour | 255/76 |
| 2,490,350 | A | 12/1949 | Grable | 166/4 |
| 2,679,903 | A | 6/1954 | McGowen, Jr. et al. | 166/1 |
| 2,847,189 | A | 8/1958 | Shook | 255/76 |
| 3,087,552 | A | 4/1963 | Graham | |

(List continued on next page.)

FOREIGN PATENT DOCUMENTS

| | | | |
|---|---|---|---|
| CA | 1067819 | 12/1979 | E21B/43/25 |
| WO | WO 01/83932 A1 | 11/2001 | E21B/7/20 |

OTHER PUBLICATIONS

Nackerud Product Description, Rec'd Sep. 27, 2001.
Pend Pat App, Monty H. Rial et al., "*Pantograph Underreamer*," SN 09/929,551 (067083.0126), Filed Aug. 13, 2001.

(List continued on next page.)

*Primary Examiner*—David Bagnell
*Assistant Examiner*—Jennifer H Gay
(74) *Attorney, Agent, or Firm*—Baker Botts L.L.P.

(57) ABSTRACT

An underreamer for forming a cavity within a well bore includes a housing adapted to be rotatably disposed within the well bore and a piston slidably coupled to the housing. The underreamer also includes a first cutter having a first end and a second end. The first end of the first cutter is pivotally coupled to the housing. The underreamer further includes a second cutter having a first end and a second end. The first end of the second cutter is coupled to the piston. The second end of the first cutter is coupled to the second cutter such that an axial force applied to the piston is operable to slide the piston relative to the housing and extend the second end of the second cutter radially outward relative to the housing from a retracted position to form the cavity when the housing is rotated relative to the well bore.

31 Claims, 4 Drawing Sheets

U.S. PATENT DOCUMENTS

| | | | | | |
|---|---|---|---|---|---|
| 3,126,065 | A | | 3/1964 | Chadderdon | |
| 3,339,647 | A | | 9/1967 | Kammerer, Jr. | 175/268 |
| 3,379,266 | A | | 4/1968 | Fletcher | 175/285 |
| 3,397,750 | A | | 8/1968 | Wicklund | 175/18 |
| 3,443,648 | A | | 5/1969 | Howard | 175/103 |
| 3,528,516 | A | | 9/1970 | Brown | 175/267 |
| 3,598,193 | A | * | 8/1971 | Hilton | 175/215 |
| 3,684,041 | A | | 8/1972 | Kammerer, Jr. et al. | 175/267 |
| 3,731,753 | A | * | 5/1973 | Weber | 175/285 |
| 3,757,876 | A | | 9/1973 | Pereau | 175/267 |
| 3,757,877 | A | | 9/1973 | Leathers | 175/269 |
| 4,073,351 | A | | 2/1978 | Baum | 175/14 |
| 4,158,388 | A | | 6/1979 | Owen et al. | 166/286 |
| 4,169,510 | A | | 10/1979 | Meigs | 175/65 |
| 4,189,184 | A | | 2/1980 | Green | 299/8 |
| 4,243,099 | A | | 1/1981 | Rodgers, Jr. | 166/65 R |
| 4,278,137 | A | | 7/1981 | Van Eek | 175/267 |
| 4,323,129 | A | | 4/1982 | Cordes | 175/285 |
| 4,366,988 | A | | 1/1983 | Bodine | 299/14 |
| 4,396,076 | A | | 8/1983 | Inoue | 175/265 |
| 4,401,171 | A | | 8/1983 | Fuchs | 175/267 |
| 4,407,376 | A | | 10/1983 | Inoue | 175/267 |
| 4,494,616 | A | | 1/1985 | McKee | 175/67 |
| 4,549,630 | A | | 10/1985 | Brown | 181/106 |
| 4,558,744 | A | | 12/1985 | Gibb | 166/335 |
| 4,565,252 | A | | 1/1986 | Campbell et al. | 175/269 |
| 4,618,009 | A | | 10/1986 | Carter et al. | 175/267 |
| 4,674,579 | A | | 6/1987 | Geller et al. | 175/45 |
| 4,715,440 | A | | 12/1987 | Boxell et al. | 166/100 |
| 4,830,105 | A | | 5/1989 | Petermann | 166/241 |
| 4,887,668 | A | | 12/1989 | Lynde et al. | 166/55.8 |
| 5,009,273 | A | * | 4/1991 | Grabinski | 175/61 |
| 5,036,921 | A | | 8/1991 | Pittard et al. | 166/298 |
| 5,135,058 | A | | 8/1992 | Millgard et al. | 175/71 |
| 5,148,875 | A | | 9/1992 | Karlsson et al. | 175/62 |
| 5,197,553 | A | | 3/1993 | Leturno | 175/57 |
| 5,201,817 | A | | 4/1993 | Hailey | 175/269 |
| 5,242,017 | A | | 9/1993 | Hailey | 166/55.8 |
| 5,255,741 | A | | 10/1993 | Alexander | 166/278 |
| 5,271,472 | A | | 12/1993 | Leturno | 175/107 |
| 5,348,091 | A | | 9/1994 | Tchakararov et al. | 166/217 |
| 5,363,927 | A | | 11/1994 | Frank | 175/67 |
| 5,385,205 | A | | 1/1995 | Hailey | 166/55.8 |
| 5,392,862 | A | | 2/1995 | Swearingen | 166/386 |
| 5,402,856 | A | | 4/1995 | Warren et al. | 175/57 |
| 5,413,183 | A | | 5/1995 | England | 175/53 |
| 5,494,121 | A | | 2/1996 | Nackerud | 175/263 |
| 5,499,687 | A | | 3/1996 | Lee | 175/317 |
| 5,722,489 | A | | 3/1998 | Lambe et al. | 166/269 |
| 5,853,054 | A | | 12/1998 | McGarian et al. | 175/267 |
| 6,070,677 | A | | 6/2000 | Johnston, Jr. | 175/57 |
| 6,082,461 | A | | 7/2000 | Newman | 166/381 |
| 6,217,260 | B1 | * | 4/2001 | He | 405/237 |
| 6,227,312 | B1 | | 5/2001 | Eppink | 175/57 |
| 6,378,626 | B1 | | 4/2002 | Wallace | 175/19 |
| 6,412,556 | B1 | | 7/2002 | Zupanick | 166/255.2 |
| 6,454,000 | B1 | | 9/2002 | Zupanick | 166/243 |
| 6,494,272 | B1 | | 12/2002 | Eppink et al. | 175/57 |

OTHER PUBLICATIONS

Pend Pat App, Monty H. Rial et al., "*Pantograph Underreamer*," SN 09/929,175 (067083.0142), Filed Aug. 13, 2001.

Pend Pat App, Monty H. Rial et al., "*Pantograph Underreamer*," SN 09/929,568 (067083.0145), Filed Aug. 13, 2001.

Pend Pat App, Lawrence W. Diamond et al., "*Single–BladeUnderreamer*," SN 09/932,482 (067083.0125), Filed Aug. 17, 2001.

Pend Pat App, Lawrence W. Diamond et al., "*Multi–BladeUnderreamer*," SN 09/932,487 (067083.0136), Filed Aug. 17, 2001.

Armell et al., United States Patent Publication 2002/0070052, filed Dec. 6, 2001, Pat. App. No. 10/008,985, published Jun. 13, 2002.

Notification of Transmittal of the International Search Report or the Declaration (PCT Rule 44.1) mailed Sep. 2, 2003 (8 pages) re International Application No. PCT/US 03/14828, May 12, 2003.

* cited by examiner

PANTOGRAPH UNDERREAMER

RELATED APPLICATIONS

This application is related to application Ser. No. 09/929,551, entitled "Pantograph Underreamer," filed on Aug. 13, 2001; application Ser. No. 09/929,175, entitled "Pantograph Underreamer," filed on Aug. 13, 2001; and application Ser. No. 09/929,568, entitled "Pantograph Underreamer," filed on Aug. 13, 2001

TECHNICAL FIELD OF THE INVENTION

This invention relates in general to the field of subterranean exploration and, more particularly, to a pantograph underreamer.

BACKGROUND OF THE INVENTION

Underreamers are generally used to form an enlarged cavity in a well bore extending through a subterranean formation. The cavity may then be used to collect resources for transport to the surface, as a sump for the collection of well bore formation cuttings and the like, or for other suitable subterranean exploration and resource production operations. Additionally, the cavity may be used in well bore drilling operations to provide an enlarged target for constructing multiple intersecting well bores.

One example of an underreamer includes a plurality of cutting blades pivotally coupled to a lower end of a drill pipe. Centrifugal forces caused by rotation of the drill pipe extends the cutting blades outwardly and diametrically opposed to each other. As the cutting blades extend outwardly, the centrifugal forces cause the cutting blades to contact the surrounding formation and cut through the formation. The drill pipe may be rotated until the cutting blades are disposed in a position substantially perpendicular to the drill pipe, at which time the drill pipe may be raised and/or lowered within the formation to form a cylindrical cavity within the formation.

Conventional underreamers, however, suffer several disadvantages. For example, the underreamer described above generally requires high rotational speeds to produce an adequate level of centrifugal force to cause the cutting blades to cut into the formation. An equipment failure occurring during high speed rotation of the above-described underreamer may cause serious harm to operators of the underreamer as well as damage and/or destruction of additional drilling equipment.

Additionally, density variations in the subsurface formation may cause each of the cutting blades to extend outwardly at different rates and/or different positions relative to the drill pipe. The varied positions of the cutting blades relative to the drill pipe may cause an out-of-balance condition of the underreamer, thereby creating undesired vibration and rotational characteristics during cavity formation, as well as an increased likelihood of equipment failure.

SUMMARY OF THE INVENTION

Accordingly, a need has arisen for an improved underreamer that provides increased control of subterranean cavity formation. The present invention provides a pantograph underreamer that addresses shortcomings of prior underreamers.

According to one embodiment of the present invention, an underreamer for forming a cavity within a well bore includes a housing adapted to be rotatably disposed within the well bore and a piston slidably coupled to the housing. The underreamer also includes a first cutter having a first end and a second end. The first end of the first cutter is pivotally coupled to the housing. The underreamer further includes a second cutter having a first end and a second end. The first end of the second cutter is coupled to the piston. The second end of the first cutter is coupled to the second cutter such that an axial force applied to the piston is operable to slide the piston relative to the housing and extend the second end of the second cutter radially outward relative to the housing from a retracted position to form the cavity when the housing is moved relative to the well bore.

According to another embodiment of the present invention, a method for forming a cavity within a well bore includes providing an underreamer within the well bore. The underreamer includes a housing and a piston. The piston is slidably positioned in the housing. The underreamer further includes a plurality of cutter sets, each cutter set having a first end coupled to the housing and a second end coupled to the piston. The method also includes applying an axial force to the piston and extending the cutter sets radially outward from a retracted position relative to the housing in response to movement of the piston relative to the housing from the applied force. The method further includes moving the underreamer within the well bore to form the cavity.

Embodiments of the present invention provide several technical advantages. For example, according to certain embodiments of the present invention, a downwardly directed force is applied to a piston of the underreamer to cause outwardly directed movement of cutters into a subterranean formation. The downwardly directed force applied to the piston may be varied to produce corresponding varying pressures on the formation by the cutters. Thus, the present invention may be used to accommodate a variety of formation densities and compositions. Additionally, decreased rotational speeds of the underreamer may be used to form the cavity, thereby substantially reducing or eliminating hazards associated with high speed rotating mechanisms.

Particular embodiments substantially reduce or eliminate out-of-balance conditions resulting from rotation of the underreamer within a well bore. For example, according to certain embodiments of the present invention, an end of each cutter set is coupled to the piston, thereby resulting in substantially uniform extension of each of the cutter sets relative to the underreamer housing. Thus, out-of-balance conditions caused by varying positions of cutting blades is substantially reduced or eliminated.

Other technical advantages will be readily apparent to one skilled in the art from the following figures, descriptions, and claims.

BRIEF DESCRIPTION OF THE DRAWINGS

For a more complete understanding of the present invention and the advantages thereof, reference is now made to the following descriptions taken in connection with the accompanying drawings in which.

DETAILED DESCRIPTION OF THE INVENTION

Figure 1:
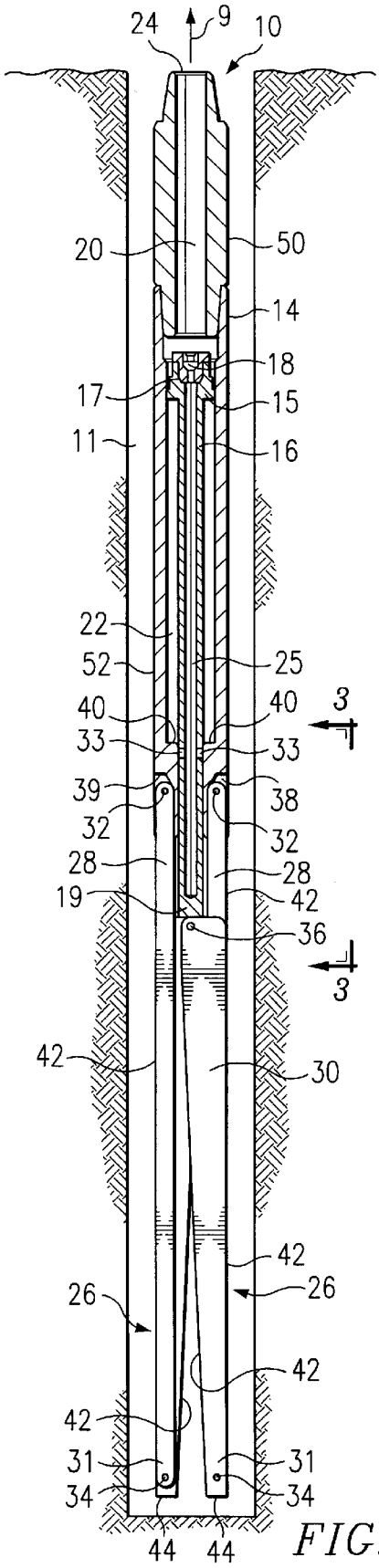
FIG. 1 is diagram illustrating an underreamer in accordance with an embodiment of the present invention.

FIG. 1 illustrates an underreamer 10 in accordance with an embodiment of the present invention. Underreamer includes a housing 14 illustrated as being substantially vertically disposed within a well bore 11. However, it should be understood that underreamer 10 may also be used in non-vertical cavity forming operations.

Underreamer 10 includes a piston 16 slidably positioned within a cavity 22 of housing 14. A nozzle 18 is coupled with a first end 17 of piston 16. Underreamer 10 also includes cutter sets 26 pivotally coupled to housing 14. In this embodiment, cutter sets 26 are each pivotally coupled to housing 14 via pins 32; however, other suitable methods may be used to provide pivotal or rotational movement of cutter sets 26 relative to housing 14.

Each cutter set 26 contains a first cutter 28 and a second cutter 30. Each first cutter 28 is pivotally coupled to a respective second cutter 30. In the illustrated embodiment, each first cutter 28 is pivotally coupled to a second cutter 30 via a pin 34; however, other suitable methods may be used to provide pivotal or rotational movement of first and second cutters 28 and 30 relative to one another.

The locations on each first cutter 28 and second cutter 30 where cutters 28 and 30 are coupled may be at a point that is not at the ends of first cutter 28 and/or second cutter 30. Coupling first and second cutters 28 and 30 at a location other than their ends can shield and protect pins 34 during rotation of underreamer 10 since pins 34 would not be in contact with exposed surfaces of well bore 11 during rotation. Coupling first and second cutters 28 and 30 at such locations also allows for tips 31 of cutters 28 and 30 to absorb much of the wear and tear from contact with well bore 11. In particular embodiments, tips 31 may be replaced as they get worn down during rotation of underreamer 10. Tips 31 may be dressed with a variety of different cutting materials, including, but not limited to, polycrystalline diamonds, tungsten carbide inserts, crushed tungsten carbide, hard facing with tube barium, or other suitable cutting structures and materials, to accommodate a particular subsurface formation.

Each second cutter 30 is pivotally coupled to a second end 19 of piston 16. In the illustrated embodiment, each of second cutters 30 is pivotally coupled to second end 19 of piston 16 using a nut and bolt 36 connection; however, other suitable methods may be used to provide pivotal or rotational movement of second cutters 30 relative to piston 16 and each other. For example, in other embodiments one or more pins may be used to couple each second cutter 30 to piston 16.

In the illustrated embodiment, housing 14 also includes outwardly facing recesses 38 which are each adapted to receive a first cutter 28. Housing 14 may have a bevel 39 at each recess 38 in order to limit the rotational movement of first cutters 28 when piston 16 moves relative to housing 14.

In the embodiment illustrated in FIG. 1, each of first cutters 28 and second cutters 30 comprises side cutting surfaces 42 and an end cutting surface 44. Cutting surfaces 42 and 44 may be dressed with a variety of different cutting materials, including, but not limited to, polycrystalline diamonds, tungsten carbide inserts, crushed tungsten carbide, hard facing with tube barium, or other suitable cutting structures and materials, to accommodate a particular subsurface formation. Additionally, various cutting surfaces 42 and 44 configurations may be machined or formed on first cutters 28 or second cutters 30 to enhance the cutting characteristics of first cutters 28 or second cutters 30.

In the embodiment illustrated in FIG. 1, housing 14 includes an upper portion 50 threadably coupled to a lower portion 52. Upper portion 50 includes inlet 24 disposed in fluid communication with an internal passage 20 proximate to an upper end of internal passage 20. Internal passage 20 provides a pressurized fluid to first end 17 of piston 16. Thus, in operation, the pressurized fluid disposed through internal passage 20 to first end 17 of piston 16 applies an axial force to first end 17 of piston 16, thereby causing movement of piston 16 relative to housing 14. Nozzle 18 coupled with first end 17 of piston 16 restricts the flow of the pressurized fluid provided within internal passage 20 to an internal fluid passage 25 of piston 16. Internal fluid passage 25 is aligned with internal passage 20 of upper portion 50.

Nozzle 18 may be adjusted as desired such that the pressurized fluid may pass to internal fluid passage 25 of piston 16. Piston 16 also includes outlets 33 disposed in fluid communication with internal fluid passage 25 proximate to a lower end 33 of internal fluid passage 25. The pressurized fluid may exit internal fluid passage 25 into well bore 11 through outlets 33.

In response to movement of piston 16 relative to housing 14, first cutters 28 rotate about pins 32 and second cutters 30 rotate about bolt 36 extending cutter sets 26 radially outward relative to housing 14. Housing 14 is rotated within well bore 11 as cutter sets 26 extend radially outward relative to housing 14. Rotation of housing 14 may be achieved using a drill string attached to housing 14; however, other suitable methods of rotating housing 14 may be utilized. For example, a downhole motor in well bore 11 may be used to rotate housing 14. In particular embodiments, both a downhole motor and a drill string may be used to rotate housing 14. The drill string may also aid in stabilizing housing 14 in well bore 11. Through rotation of housing 14 and extension of the cutter sets via the movement of piston 16 relative to housing 14, underreamer 10 forms an enlarged cavity as cutting surfaces 42 and 44 come into contact with the surfaces of well bore 11. Underreamer 10 and/or piston 16 may be moved in the general direction of arrow 9 as well as in the opposite direction to further define and shape the cavity within well bore 11. Such movement of piston 16 can be achieved by varying the pressure of the fluid disposed through internal passage 20 so as to raise and lower cutter sets 26. Underreamer 10 may also be moved by raising and lowering the drill string. In particular embodiments, the enlarged cavity may be formed by moving housing 14 and/or underreamer 10 when cutter sets 26 are in an extended position without rotating housing 14.

Piston 16 includes an upper portion 15. Upper portion 15 may have a shape such that it engages an inwardly facing shoulder 40 of housing 14 formed within cavity 22 to limit the downward movement of piston 16 relative to housing 14. For example, the location of shoulder 40 may be such that upper portion 15 engages shoulder 40 when cutter sets 26 are disposed in a fully extended position relative to housing 14. However, it should be understood that other suitable methods may be used to limit the rotational movement and corresponding extended position of cutter sets 26 relative to housing 14.

Figure 2:
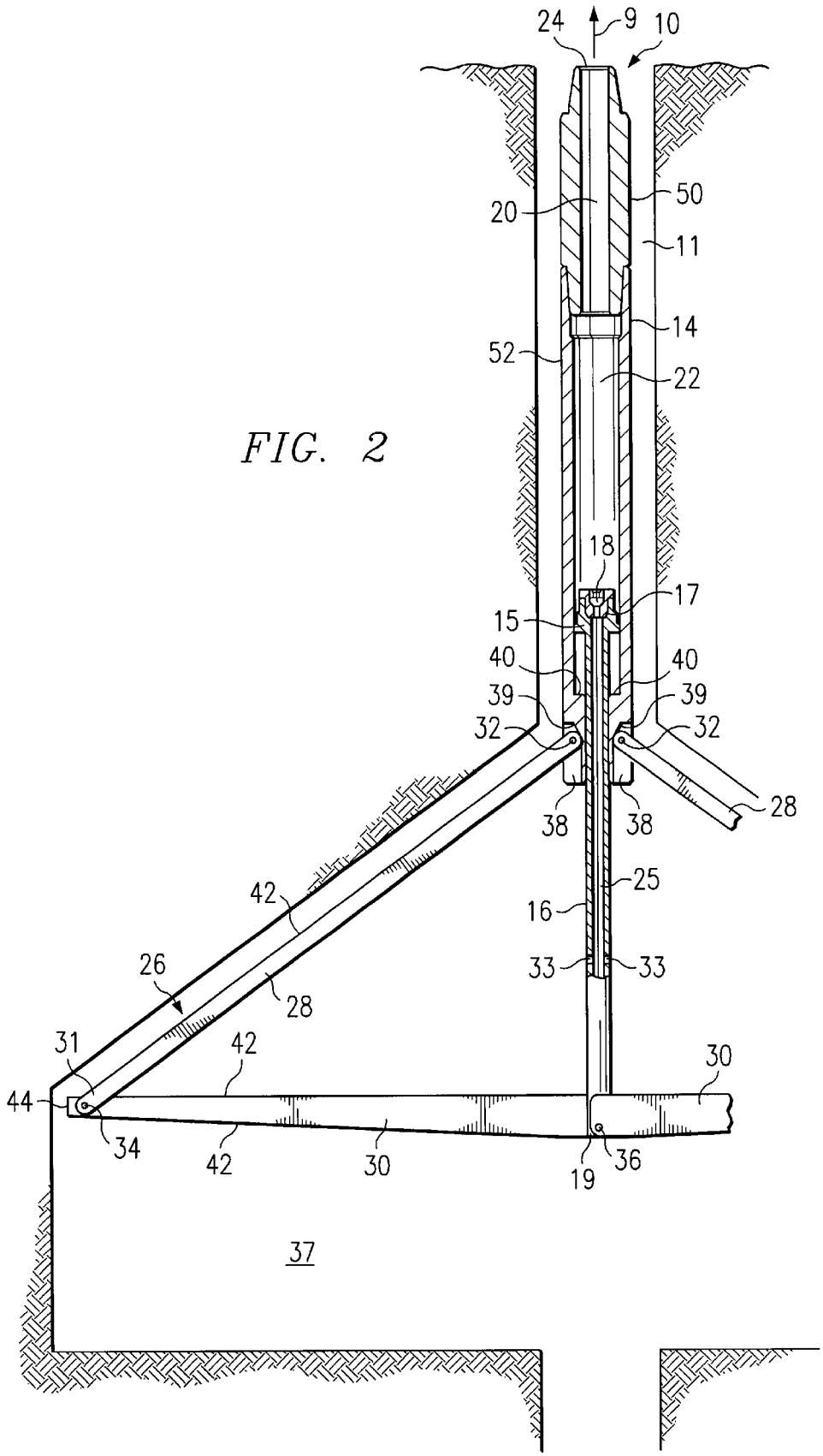
FIG. 2 is a diagram illustrating the underreamer illustrated in FIG. 1 in an extended position in accordance with an embodiment of the present invention.

FIG. 2 is a diagram illustrating underreamer 10 illustrated in FIG. 1 having cutter sets 26 disposed in an extended position relative to housing 14. In FIG. 2, piston 16 is illustrated in a downwardly disposed position relative to housing 14. Second cutters 30 are illustrated as approximately perpendicular to the longitudinal axis of piston 16. When cutter sets 26 are disposed in an extended position, piston 16 is in a position to allow for the exit of the pressurized fluid through outlets 33 into well bore 11.

An enlarged cavity 37 is formed through rotation of housing 14 and extension of cutter sets 26 as cutting surfaces 42 and 44 come into contact with the surfaces of well bore 11. As stated earlier, cavity 37 may be further defined and shaped by moving underreamer 10 and by varying the pressure of the fluid disposed through internal passage 20. It should be understood that a subterranean cavity having a shape other than the shape of cavity 37 may be formed with underreamer 10.

Figure 3:
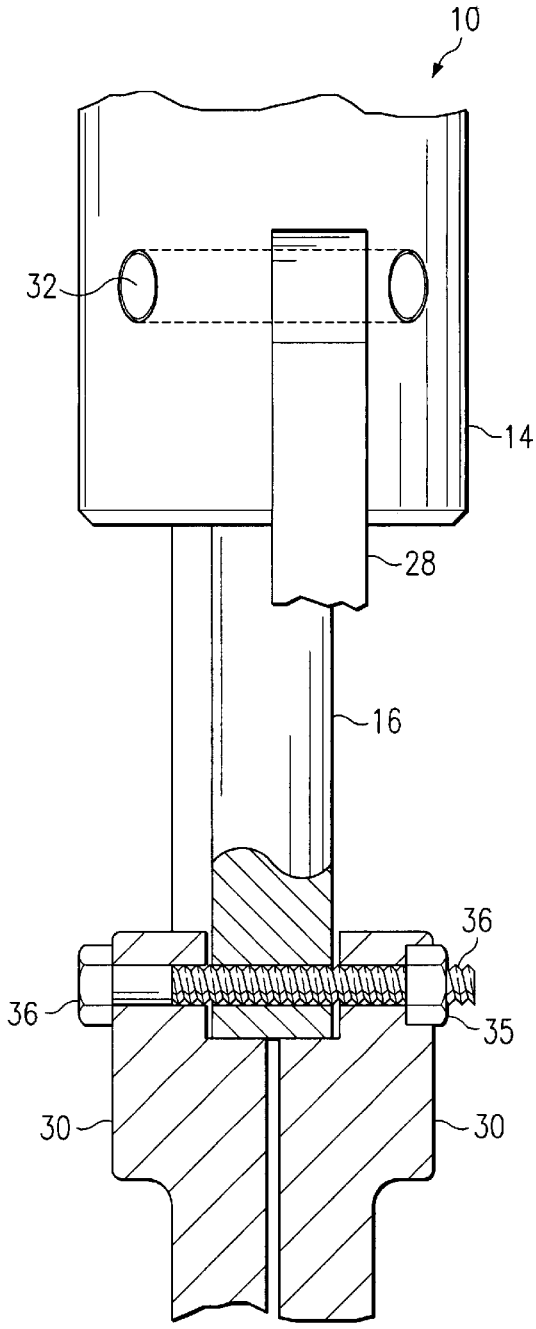
FIG. 3 is a partial side view of the underreamer of FIG. 1 taken from line 3—3.

FIG. 3 illustrates a partial side view of underreamer 10 from line 3—3 of FIG. 1 with portions broken away. First cutter 28 is shown coupled to housing 14. Piston 16 extends through housing 14. Second cutters 30 are coupled to piston 16 and to each other using nut 35 and bolt 36. In other embodiments, second cutters 30 may be coupled to piston 16 using one or more pins. Furthermore, in particular embodiments second cutters 30 may not be coupled to each other.

Figure 4:
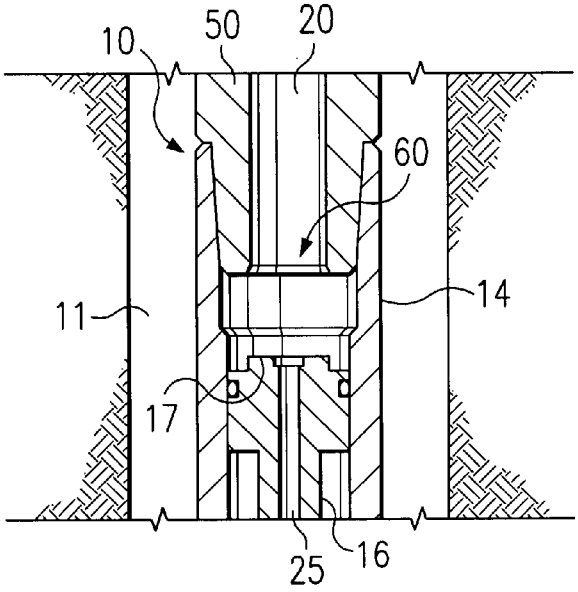
FIG. 4 is a diagram illustrating a portion of an underreamer in accordance with another embodiment of the present invention.

FIG. 4 illustrates a section of underreamer 10 in accordance with another embodiment of the present invention. In this embodiment, underreamer 10 includes a deformable member 60 disposed proximate first end 17 of piston 16. Deformable member 60 is constructed having a predetermined deformation pressure (the pressure at which deformable member 60 deforms to allow pressurized fluid to enter internal fluid passage 25 of piston 16). As an example only, deformation member 60 may be constructed such that deformation occurs at approximately 750 pounds per square inch (psi). Thus, deformable member 60 substantially prevents pressurized fluid from entering the internal fluid passage 25 at fluid pressures below the deformation pressure, thereby providing an axial force to piston 16.

The pressure of the fluid within internal passage 20 may be increased to a level exceeding the predetermined deformation pressure associated with deformable member 60, thereby providing fluid communication from internal passage 20 of upper portion 50 of housing 14 to internal fluid passage 25. Correspondingly, the fluid within internal passage 20 may be communicated outwardly through outlets of piston 16 to well bore 11 to facilitate cutting removal and cavity formation. Additionally, the pressure of the fluid within internal passage 20 may be varied prior to reaching the deformation pressure to accommodate applying variable pressures on the subsurface formation during cavity formation by the cutter sets.

The axial force provided when deformable member 60 prevents pressurized fluid from entering internal fluid passage 25 may be greater than the axial force provided after deformable member 60 has deformed, allowing the fluid to enter fluid passage 25 and exit through outlets of piston 16. Such a greater axial force may be necessary to start the movement of piston 16 and the formation of the cavity.

Figure 5:
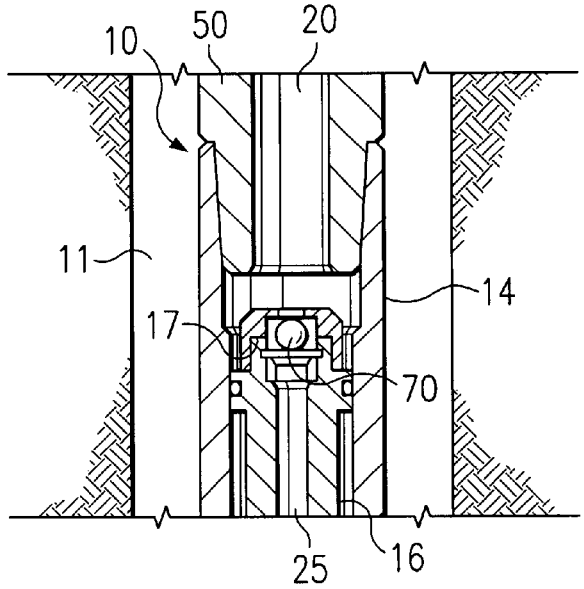
FIG. 5 is a diagram illustrating a portion of an underreamer in accordance with yet another embodiment of the present invention.

FIG. 5 illustrates a section of underreamer 10 in accordance with yet another embodiment of the present invention. In this embodiment, underreamer 10 includes an elastomer object 70 disposed at first end 17 of piston 16. Elastomer object 70 may comprise an elastomeric ball or other suitable flexible object that may be deformed at a predetermined deformation pressure.

In operation, pressurized fluid is provided within internal passage 20 to first end 17 of piston 16. Elastomer object 70 substantially prevents passage of the pressurized fluid into internal fluid passage 25 of piston 16, thereby providing an axial force to piston 16.

The pressure of the fluid within internal passage 20 may be increased to a level exceeding the predetermined deformation pressure associated with elastomer object 70. As elastomer object 70 deforms, the pressure of the fluid within internal passage 20 of upper portion 50 of housing 14 will cause elastomer object 70 to pass through to internal fluid passage 25, thereby providing fluid communication from internal passage 20 to internal fluid passage 25. Correspondingly, the fluid within internal passage 20 may be communicated outwardly through outlets of piston 16 to well bore 11 to facilitate cutting removal and cavity formation. Additionally, the pressure of the fluid within internal passage 20 may be varied prior to reaching the deformation pressure to accommodate applying variable pressures on the subsurface formation during cavity formation by the cutter sets.

The axial force provided when elastomeric object 70 prevents pressurized fluid from entering internal fluid passage 25 may be greater than the axial force provided after elastomeric object 70 deforms, allowing the fluid to enter fluid passage 25 and exit through outlets of piston 16. Such a greater axial force may be necessary to start the movement of piston 16 and the formation of the cavity.

FIGS. 6A through 6D are diagrams illustrating sections of an underreamer 10 in accordance with alternative embodiments of the present invention. Underreamer 10 illustrated in each of the FIGS. 6A through 6D includes an interchangeable portion 100 coupled to first end 17 of piston 16. Interchangeable portion 100 may be removed and replaced with a variety of functional alternatives to provide operational flexibility of underreamer 10.

Interchangeable portion 100 in each of the embodiments illustrated in FIGS. 6A through 6D includes an internal passage 102 disposed in communication with internal fluid passage 25 of piston 16. Interchangeable portion 100 also includes externally formed threads 104 adapted to engage corresponding internally formed threads 106 of piston 20 to removably couple interchangeable portion 100 to piston 16. However, interchangeable portion 100 may be otherwise removably coupled to first end 17 of piston 16.

Piston 16 may also include a plurality of inwardly extending openings 108 adapted for receiving set screws or other devices for securing interchangeable portion 100 relative to piston 16 and substantially prevent rotation of interchangeable portion 100 relative to piston 16 during operational use. Interchangeable portion 100 may also include an outwardly facing annular recess 110 adapted for receiving a sealing member 112 to substantially prevent undesired fluid movement between interchangeable portion 100 and piston 16.

Figure 6A:
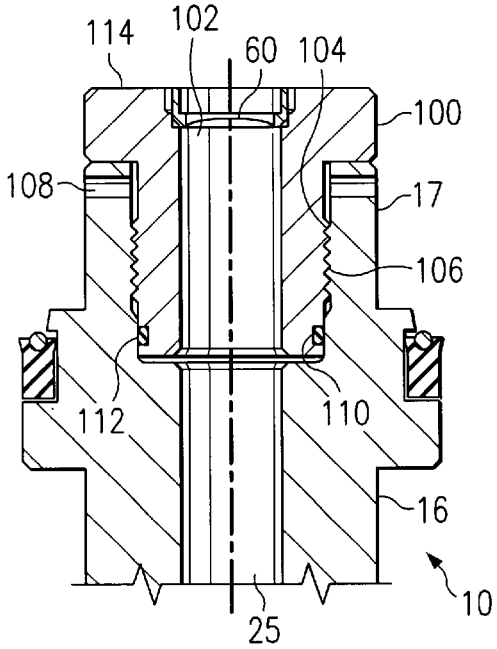
FIGS. 6A–6D are diagrams illustrating portions of underreamers in accordance with particular embodiments of the present invention.

Referring to FIG. 6A, interchangeable portion 100 in this embodiment includes deformable member 60 disposed proximate to a first end 114 of interchangeable portion 100 and over internal passage 102. After deformation of deformable member 60, a fluid passes into internal fluid passage 25 of piston 16 through passage 102 of interchangeable portion 100. The movement of piston 16 and actuation of cutter sets of underreamer 10 in this embodiment operates as described above with respect to FIGS. 1 and 2.

Figure 6B:
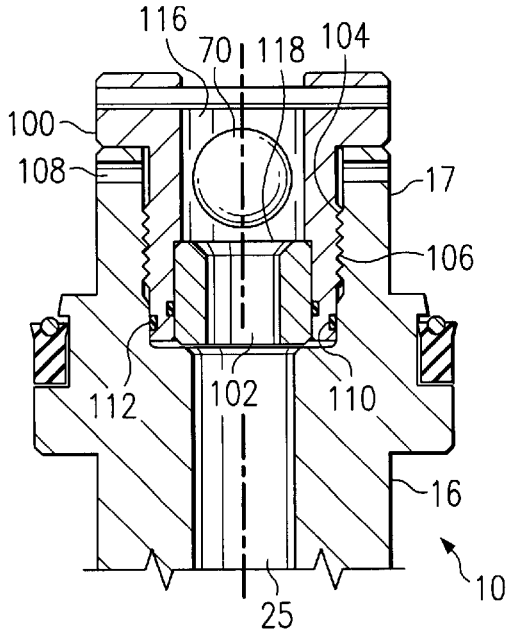

Referring to FIG. 6B, interchangeable portion 100 in this embodiment includes elastomer object 70 disposed over passage 102. Elastomer object 70 is disposed within an internal cavity 116 of portion 100 such that an axial force applied to elastomer object 70 seats elastomer object 70 against a seating area 118 of interchangeable portion 100. Upon an increase of the axial force and deformation of elastomer object 70, elastomer object 70 passes through passage 102 and into passage 25, thereby providing fluid communication between passages 102 and 25. The movement of piston 16 and actuation of cutter sets of underreamer 10 in this embodiment operates as described above with respect to FIGS. 1 and 2.

Figure 6C:
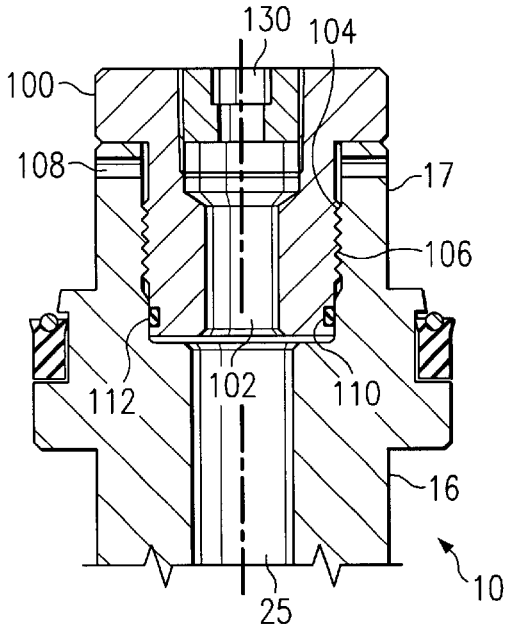

Referring to FIG. 6C, interchangeable portion 100 in this embodiment includes nozzle 130 disposed proximate to and in communication with passage 102. Nozzle 130 restricts a flow of a pressurized fluid, thereby providing movement of piston 16 relative to the housing while routing a portion of the fluid into passage 25 via passage 102. The movement of piston 16 and actuation of cutter sets of underreamer 10 in this embodiment operates as described above with respect to FIGS. 1 and 2.

Figure 6D:
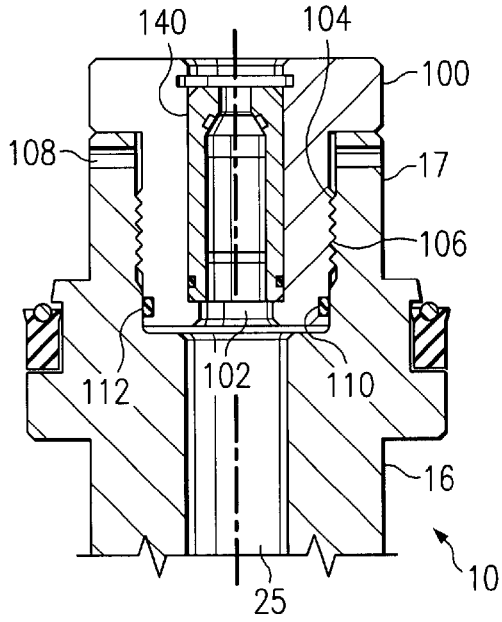

Referring to FIG. 6D, interchangeable portion 100 in this embodiment includes relief valve 140 disposed proximate to and in communication with passage 102. As a fluid is provided in contact with interchangeable portion 100, relief valve 140 restricts a flow of the fluid into passage 102 until a predetermined pressure is obtained, thereby resulting in movement of piston 16 relative to the housing. After the predetermined fluid pressure is obtained, relief valve 140 provides communication of the fluid into passage 25 through passage 102. Thus, the movement of piston 16 and actuation of cutter sets in this embodiment operates as described above.

Thus, interchangeable portion 100 may be adapted to provide a variety of operating characteristics adapted to the drilling requirements of a particular well bore. Interchangeable portion 100 may be readily replaced with the desired configuration to provide piston 16 movement and fluid flow to cutter sets as described above. Therefore, the present invention provides greater flexibility than prior underreamers.

Although the present invention has been described in detail, various changes and modifications may be suggested to one skilled in the art. It is intended that the present invention encompasses such changes and modifications as falling within the scope of the appended claims.

What is claimed is:

1. An underreamer for forming a cavity within a well bore, comprising:

a housing adapted to be rotatably disposed within the well bore;

a piston slidably positioned in the housing, the piston comprising a fluid passage disposed in fluid communication with an internal passage of the housing;

a deformable member disposed proximate the fluid passage, wherein an increase in the axial force deforms the member such that a fluid travels through the fluid passage;

one or more first cutters each having a first end and a second end, the first end of each first cutter pivotally coupled to the housing; and one or more second cutters each having a first end and a second end, the first end of each second cutter pivotally coupled to the piston and the second end of each first cutter pivotally coupled to the second cutter such that an axial force applied to the piston is operable to slide the piston relative to the housing and extend the second end of each second cutter radially outward relative to the housing from a retracted position to form the cavity.

2. The underreamer of claim 1, wherein the axial force comprises hydraulic pressure from a pressurized fluid.

3. The underreamer of claim 1, further comprising a nozzle disposed proximate the fluid passage, wherein the nozzle is operable to communicate a pressurized fluid through the fluid passage.

4. The underreamer of claim 1, wherein the deformable member comprises an elastomer object and wherein the increase in the axial force transfers the elastomer object downwardly within the fluid passage.

5. The underreamer of claim 1, further comprising a relief valve disposed proximate the fluid passage, the relief valve operable to communicate a predetermined amount of a pressurized fluid through the fluid passage in response to a predetermined level of the axial force.

6. The underreamer of claim 1, wherein the piston extends through a cavity of the housing.

7. The underreamer of claim 1, wherein the first cutter is coupled to a medial portion of the second cutter.

8. The underreamer of claim 1, wherein the first end of each second cutter remains disposed along a central axis of the underreamer when the second end of each second cutter extends radially outward.

9. The underreamer of claim 1, wherein the first and second cutters are disposed in an overlapping orientation relative to each other in the retracted position.

10. The underreamer of claim 1, wherein at least one of the first or second cutters comprises a replaceable tip at its second end, the replaceable tip extending past the point at which the first and second cutters are coupled.

11. A method for forming a cavity within a well bore, comprising:

providing an underreamer within the well bore, the underreamer having a housing and a piston, the piston slidably positioned in the housing and including a deformable member disposed proximate a fluid passage of the piston, the underreamer further having a plurality of cutter sets, each cutter set having a first end coupled to the housing and a second end coupled to the piston;

applying an axial force to the piston by providing a pressurized fluid through an internal passage of the housing, wherein an increase in the axial force deforms the deformable member such that the fluid travels through the fluid passage;

extending the cutter sets radially outward from a retracted position relative to the housing in response to movement of the piston relative to the housing from the applied force; and moving the underreamer within the well bore to form the cavity.

12. The method of claim 11, wherein the underreamer further comprises a nozzle disposed proximate a fluid passage of the piston, the nozzle operable to communicate a pressurized fluid through the fluid passage.

13. The method of claim 11, wherein the deformable member comprises an elastomer object and wherein the increase in the axial force transfers the elastomer object downwardly within the fluid passage.

14. The method of claim 11, wherein the underreamer further comprises a relief valve disposed proximate a fluid passage of the piston, the relief valve operable to communicate a predetermined amount of a pressurized fluid through the fluid passage in response to a predetermined level of the axial force.

15. The method of claim 11, wherein:

each of the cutter sets comprises a first cutter and a second cutter pivotally coupled to the first cutter, each of the first and second cutters having a first end and a second end, the first end of the first cutter corresponding to the first end of the cutter set, the first end of the second cutter corresponding to the second end of the cutter set; and extending the cutter sets comprises extending the second ends of the first and second cutters radially outward.

16. The method of claim 15, wherein an end of the first cutter is coupled to a medial portion of the second cutter.

17. The method of claim 15, wherein the first and second cutters are disposed in an overlapping orientation relative to each other in the retracted position.

18. The method of claim 15, wherein at least one of the first or second cutters comprises a replaceable tip at its second end, the replaceable tip extending past a point at which the first and second cutters are coupled.

19. The method of claim 11, wherein each of the cutter sets is disposed within an outwardly facing recess of the housing when the cutter sets are in a retracted position.

20. An underreamer for forming a cavity within a well bore, comprising:

a housing adapted to be rotatably disposed within the well bore;

a piston slidably positioned in the housing, the piston comprising a fluid passage disposed in fluid communication with an internal passage of the housing;

a deformable member disposed proximate the fluid passage, wherein an increase in the axial force deforms the member such that a fluid travels through the fluid passage; and a plurality of cutter sets each having a first end pivotally coupled to the housing and a second end pivotally coupled to the piston such that an axial force applied to the piston is operable to slide the piston relative to the housing to correspondingly extend the cutter sets radially outward relative to the housing from a retracted position to form the cavity when the housing is rotated relative to the well bore.

21. The underreamer of claim 20, wherein the axial force comprises hydraulic pressure from a pressurized fluid.

22. The underreamer of claim 20, further comprising a nozzle disposed proximate the fluid passage, wherein the nozzle is operable to communicate a pressurized fluid through the fluid passage.

23. The underreamer of claim 20, wherein the deformable member comprises an elastomer object and wherein the increase in the axial force transfers the elastomer object downwardly within the fluid passage.

24. The underreamer of claim 20, further comprising a relief valve disposed proximate the fluid passage, the relief valve operable to communicate a predetermined amount of a pressurized fluid through the fluid passage in response to a predetermined level of the axial force.

25. The underreamer of claim 20, wherein the housing comprises a plurality of outwardly facing recesses each adapted to receive one of the cutter sets when the cutter sets are in a retracted position.

26. The underreamer of claim 20, wherein each of the cutter sets comprises:

a first cutter having a first end and a second end, the first end of the first cutter pivotally coupled to the housing; and a second cutter having a first end and a second end, the first end of the second cutter pivotally coupled to the piston, the second end of the first cutter coupled to the second cutter.

27. The underreamer of claim 26, wherein the second end of the first cutter is pivotally coupled to a medial portion of the second cutter.

28. The underreamer of claim 26, wherein the second end of the first cutter is pivotally coupled to the second end of the second cutter.

29. The underreamer of claim 26, wherein the second end of the second cutter extends radially outward in response to the sliding of the piston relative to the housing.

30. The underreamer of claim 26, wherein the first and second cutters are disposed in an overlapping orientation relative to each other in the retracted position.

31. The underreamer of claim 26, wherein at least one of the first or second cutters comprises a replaceable tip at its second end, the replaceable tip extending past the point at which the first and second cutters are coupled.

* * * * *